US009701041B2

(12) United States Patent
McFarlane

(10) Patent No.: US 9,701,041 B2
(45) Date of Patent: Jul. 11, 2017

(54) DEBRIS CATCHING APPARATUS FOR A CONCRETE MIXER

(76) Inventor: Brinsley McFarlane, Carmichael (GB)

( * ) Notice: Subject to any disclaimer, the term of this patent is extended or adjusted under 35 U.S.C. 154(b) by 0 days.

(21) Appl. No.: 14/124,229

(22) PCT Filed: Jun. 11, 2012

(86) PCT No.: PCT/GB2012/000506

§ 371 (c)(1),
(2), (4) Date: Dec. 5, 2013

(87) PCT Pub. No.: WO2012/168686

PCT Pub. Date: Dec. 13, 2012

(65) Prior Publication Data

US 2014/0098625 A1 Apr. 10, 2014

(30) Foreign Application Priority Data

| | | |
|---|---|---|
| Jun. 9, 2011 | (GB) | 1109664.1 |
| Nov. 3, 2011 | (GB) | 1118950.3 |
| Nov. 14, 2011 | (GB) | 1119524.5 |
| Feb. 28, 2012 | (GB) | 1203461.7 |
| Mar. 1, 2012 | (GB) | 1203655.4 |

(51) Int. Cl.

| | |
|---|---|
| ***B28C 5/42*** | (2006.01) |
| ***B28C 7/16*** | (2006.01) |
| ***B08B 9/00*** | (2006.01) |
| ***B08B 17/02*** | (2006.01) |

(52) U.S. Cl.

CPC ..... *B28C 5/4248* (2013.01); *B08B 9/00* (2013.01); *B08B 17/025* (2013.01); *B28C 5/4203* (2013.01); *B28C 7/168* (2013.01)

(58) Field of Classification Search

CPC ... B28C 5/4203; B28C 5/4244; B28C 5/4248; B28C 5/4251; B28C 7/168; B08B 9/00; B08B 17/025

USPC ..... 366/53–63, 68, 187

See application file for complete search history.

(56) References Cited

U.S. PATENT DOCUMENTS

| | | | | |
|---|---|---|---|---|
| 2,713,929 | A * | 7/1955 | Castendyck | 193/10 |
| 3,279,766 | A * | 10/1966 | Mendoza | 366/68 |
| 4,273,231 | A * | 6/1981 | Hodneland | 193/10 |
| 4,392,563 | A * | 7/1983 | Holman | 193/10 |
| 4,688,667 | A * | 8/1987 | Peterson | 193/10 |
| 5,127,740 | A * | 7/1992 | DeBoer | 366/2 |

(Continued)

FOREIGN PATENT DOCUMENTS

| | | | |
|---|---|---|---|
| DE | 19920016144 | U1 | 2/1993 |
| EP | 2845704 | A1 * | 3/2015 |

(Continued)

OTHER PUBLICATIONS

English Translation of JP 2007-210103 A.*

(Continued)

*Primary Examiner* — Charles Cooley
(74) *Attorney, Agent, or Firm* — Buchanan Nipper

(57) ABSTRACT

An apparatus for a lorry-based concrete mixer comprising a vessel adapted to be positioned beneath a concrete mixer discharge chute portion when the discharge chute is in a stowed position, the vessel being adapted, in use, to receive and retain debris exiting the discharge chute portion while the lorry-based concrete mixer is in motion, the vessel being further adapted to receive wash down water.

24 Claims, 4 Drawing Sheets

(56) References Cited

U.S. PATENT DOCUMENTS

| | | | | |
|---|---|---|---|---|
| 5,531,518 | A * | 7/1996 | Alves | 366/68 |
| 5,605,398 | A * | 2/1997 | Cronquist | 366/68 |
| 5,685,978 | A * | 11/1997 | Petrick et al. | 210/241 |
| 5,741,065 | A * | 4/1998 | Bell et al. | 366/54 |
| 6,000,645 | A * | 12/1999 | Preisser | 241/41 |
| 6,039,468 | A * | 3/2000 | Kowalcyzk | 366/41 |
| 6,155,277 | A * | 12/2000 | Barry | 134/104.4 |
| RE37,018 | E * | 1/2001 | Cronquist | 366/68 |
| 6,418,948 | B1 * | 7/2002 | Harmon | 134/168 R |
| 6,461,098 | B1 * | 10/2002 | Elefsrud | 414/618 |
| 6,491,070 | B1 * | 12/2002 | Espina Frutos | 141/93 |
| 6,640,817 | B2 * | 11/2003 | Harmon | 134/22.18 |
| 6,782,925 | B2 * | 8/2004 | Raposo et al. | 141/5 |
| 6,783,007 | B2 * | 8/2004 | Arbore | 209/421 |
| 6,866,047 | B1 * | 3/2005 | Marvin | 134/22.1 |
| 6,966,687 | B1 * | 11/2005 | Elefsrud | 366/26 |
| 7,117,995 | B2 * | 10/2006 | Connard, III | 209/421 |
| 7,147,360 | B2 * | 12/2006 | Elefsrud | 366/26 |
| 7,178,657 | B1 * | 2/2007 | Hafen et al. | 193/4 |
| 7,401,969 | B2 * | 7/2008 | Johnson | 366/68 |
| 7,506,672 | B2 * | 3/2009 | Manno | 141/86 |
| 7,594,524 | B2 * | 9/2009 | DeCollibus | |
| 7,913,704 | B1 * | 3/2011 | Abney, Sr. | 134/184 |
| 8,020,569 | B2 * | 9/2011 | Leonardich et al. | 134/104.4 |
| 8,079,377 | B2 * | 12/2011 | Jenkins | 134/201 |
| 8,079,746 | B2 * | 12/2011 | Lundberg et al. | 366/68 |
| 8,083,394 | B2 * | 12/2011 | Fischer et al. | 366/41 |
| 8,113,220 | B2 * | 2/2012 | Inglese | 134/104.1 |
| 8,734,587 | B2 * | 5/2014 | Pruyn et al. | 134/10 |
| 8,858,062 | B2 * | 10/2014 | Guthrie et al. | 366/68 |
| 8,967,358 | B2 * | 3/2015 | Shimizu | 193/22 |
| 2002/0179119 | A1 * | 12/2002 | Harmon | 134/22.18 |
| 2003/0070980 | A1 * | 4/2003 | Ray | 210/489 |
| 2003/0079796 | A1 * | 5/2003 | Raposo et al. | 141/5 |
| 2004/0105741 | A1 * | 6/2004 | Inglese | 414/404 |
| 2004/0159595 | A1 * | 8/2004 | Connard, III | 209/680 |
| 2005/0219940 | A1 * | 10/2005 | Elefsrud | 366/14 |
| 2005/0235442 | A1 * | 10/2005 | Molter | 15/93.1 |
| 2006/0000490 | A1 * | 1/2006 | Barragan et al. | 134/10 |
| 2007/0002677 | A1 * | 1/2007 | DeCollibus et al. | 366/68 |
| 2007/0008814 | A1 * | 1/2007 | Johnson | 366/68 |
| 2007/0086270 | A1 * | 4/2007 | Harris et al. | 366/59 |
| 2007/0256707 | A1 * | 11/2007 | Leonardich et al. | 134/10 |
| 2007/0272271 | A1 * | 11/2007 | Petrowich et al. | 134/10 |
| 2008/0175092 | A1 * | 7/2008 | Manno | 366/68 |
| 2008/0251471 | A1 * | 10/2008 | Inglese | 210/800 |
| 2009/0044832 | A1 * | 2/2009 | Leonardich et al. | 134/10 |
| 2009/0229707 | A1 * | 9/2009 | Royce | 141/332 |
| 2010/0051062 | A1 * | 3/2010 | Fischer et al. | 134/23 |
| 2010/0232253 | A1 * | 9/2010 | Lundberg et al. | 366/68 |
| 2011/0197980 | A1 * | 8/2011 | Sullivan et al. | 137/544 |
| 2011/0303243 | A1 * | 12/2011 | Leonardich et al. | 134/10 |
| 2012/0111364 | A1 * | 5/2012 | Pruyn et al. | 134/10 |
| 2014/0098625 | A1 * | 4/2014 | McFarlane | B08B 17/025 366/68 |
| 2014/0356119 | A1 * | 12/2014 | Kasahara | 414/523 |
| 2016/0114497 | A1 * | 4/2016 | McFarlane | B03B 9/063 |
| 2016/0221221 | A1 * | 8/2016 | Connard, III | B28C 5/4203 |
| 2017/0072916 | A1 * | 3/2017 | Beck, III | |

FOREIGN PATENT DOCUMENTS

| | | | | |
|---|---|---|---|---|
| JP | 53148857 | A * | 12/1978 | B60S 3/00 |
| JP | S55-49943 | U | 4/1980 | |
| JP | S59-090407 | U | 6/1984 | |
| JP | S59-118511 | U | 8/1984 | |
| JP | S62-038109 | U | 3/1987 | |
| JP | H05-63807 | U | 8/1993 | |
| JP | 2007210103 | A | 8/2007 | |
| WO | 20001059638 | A1 | 10/2000 | |

OTHER PUBLICATIONS

English Translation of JP 05-063807 U.*
English Translation of DE 4336029 A1.*
International Search Report and Written Opinion, PCT/GB2012/000506, dated Nov. 13, 2012.
UKIPO Search Report, GB1210210.9, dated Sep. 12, 2012.
International Preliminary Report on Patentability, PCT/GB2012/000506, dated Dec. 27, 2013.
EPO Office Action, EP12738151.5, dated Nov. 23, 2015.

* cited by examiner

DEBRIS CATCHING APPARATUS FOR A CONCRETE MIXER

FIELD OF THE INVENTION

The present invention relates to an apparatus for a lorry based concrete mixer. Particularly, but not exclusively the apparatus relates to an apparatus for catching debris which may bounce out of the drum of a lorry based concrete mixer during transit.

BACKGROUND TO THE INVENTION

Lorry-based concrete mixers are supplied with a movable discharge chute which can be positioned in various configurations to allow the discharge of concrete from the mixer drum. When not in use, and particularly when the vehicle is in transit, the chute is swung to a stowed position.

In the stowed position, there is the possibility that any loose stones within the mixer drum can bounce down the chute onto the road. As the stone will be moving at speed, it has the potential to bounce and strike another vehicle causing damage. This has been partially alleviated, in some cases, by the incorporation of a flap mounted to the chute. The flap is positioned to prevent stones leaving the chute during transit and is moved out of the way to allow for the discharge of concrete when required. One of the drawbacks of this arrangement is that this is known for the flap to be permanently located in the discharge position obviating the benefit of the chute; permitting stones to run down the chute during transit.

In the stowed position, there is also the possibility over time that the brackets holding the chute in the stowed position can come loose with the result that the chute can potentially swing away from the discharge position towards a vehicle following the mixer.

SUMMARY OF THE INVENTION

According to a first aspect of the present invention there is provided an apparatus for a lorry-based concrete mixer, the apparatus comprising:

a vessel adapted to be positioned beneath a concrete mixer discharge chute portion when the discharge chute is in a stowed position, the vessel being adapted, in use, to receive and retain debris exiting the discharge chute portion.

Such an arrangement, in at least one embodiment of the present invention, permits debris to be captured and stored during transit, the stowed position being the position the chute is secured in for transit.

The apparatus may be adapted to receive and retain liquid debris such as slurry or wash down water.

The vessel may be adapted to receive the discharge chute portion within a vessel interior.

The discharge chute portion may be an end of the discharge chute.

The vessel may be adapted to at least partially encircle the discharge chute portion.

The vessel may be adapted to fit snugly around the discharge chute.

The vessel may be adapted to be pivotally mounted to a lorry-based concrete mixer.

The vessel may, in use, be movable between a disengaged and an engaged position, in the engaged position, the vessel being engaged with the discharge chute portion and securing the discharge chute in the stowed position.

The vessel may be lockable to the discharge chute portion.

The vessel may be movable about the pivotal mounting.

Alternatively, the vessel may, in use, be adapted to be fixed relative to a lorry-based concrete mixer. The vessel may be removable from the lorry-based concrete mixer. In this embodiment, the chute portion may be positioned adjacent the vessel, particularly the end of the discharge chute may be positioned adjacent the vessel.

In a preferred embodiment, the discharge chute portion may, in use, be positioned above the vessel.

In an embodiment, the chute portion may be lowered towards and/or into vessel, particularly the discharge chute portion may be lowered into the vessel.

The apparatus may further comprise securing means adapted to secure the discharge chute to a lorry-based concrete mixer. The securing means may be a mechanism adapted to secure the discharge chute to a frame or chassis of the lorry-based concrete mixer. The securing mechanism may be adapted to secure the discharge chute end over the vessel.

The securing mechanism may be a male member attached to one of the discharge chute or, in use, a frame or chassis of the lorry-based concrete mixer and a female member attached to the other of the discharge chute or frame or chassis of the lorry-based concrete mixer.

The male and female member, once engaged, may be arranged to prevent movement of the discharge chute in a horizontal plane. Such an arrangement prevents the discharge chute from swinging from the stowed position to the discharge position. The securing means may be the primary method of securing the discharge chute in the stowed position.

The male member may be a peg and a female member may be a loop. In an embodiment, as the chute is lowered into or towards the vessel, the peg passes into the loop. The peg may be a tapered peg.

The vessel may comprise a substantially transparent portion. A transparent portion allows a user to inspect the chute without needing to remove the vessel from the end of the chute.

The vessel may be adapted to be removably received within a cradle defined by a lorry-based concrete mixer chassis.

The vessel may comprise an outlet. An outlet may be provided to allow the vessel to be emptied.

The apparatus may further comprise an outlet grill or the like adapted to prevent larger pieces of debris from passing through the outlet.

The apparatus may further comprise a storage container.

The vessel may be in communication with the storage container such that debris can pass through the vessel outlet into the storage container.

The storage container and the vessel outlet may be connected by means of a conduit. Providing a storage container which can be located in space between, for example, the rear wheels, allows the size of the vessel to be reduced whilst still permitting the apparatus as a whole to deal with the debris coming down the chute.

The storage container may be adapted to hold fluid. In some embodiments, the vessel is in fluid communication with the storage container. Such an arrangement permits the vessel to be washed in the event of, for example, a discharge of slurry into the vessel, the slurry being flushed into the storage container. The apparatus can also be used to wash the discharge chute after depositing a load of concrete. After depositing, the discharge chute generally contains some debris which, if not removed relatively quickly, hardens, leading to further more prolonged cleaning. The arrangement of the present invention stops the fluid being washed into the public drains or onto the public highway.

The vessel may be adapted to receive the subsidiary discharge chutes. In addition to the main discharge chute, a number of additional chutes are provided to allow the mixer to discharge into different receptacles or receptacles placed in different locations.

In this stowed configuration, one or more additional chutes can be positioned around the end of the discharge chute. In one embodiment, the additional chutes can be used to provide a further shroud around the end of the discharge chute, ensuring that debris coming down the discharge chute is deflected into the vessel.

Alternatively or additionally, the vessel may be adapted to receive the subsidiary discharge chutes in the disengaged position.

In one embodiment, where the vessel is pivotally mounted to a lorry-based concrete mixer, in the disengaged position, the vessel may be rotated 90° in a horizontal plane from the engaged position. In this position, with the vessel opening facing backwards, it is relatively straightforward to hook one of the discharge chutes to the vessel for cleaning.

The vessel may be provided with attachment means to support a discharge chute such that the chute is supported by the vessel during cleaning.

The vessel may define a mouth.

The mouth may define a tapered surface, particularly an internal tapered surface.

The mouth may be adapted to receive a number of different sizes of discharge chute portions. Such an arrangement provides additional utility as one size of vessel can accommodate a number of sizes of discharge chute portions and, therefore, there is a reduced requirement for stock holdings.

The vessel may have an internal surface adapted for forming a seal with the end of the discharge chute portion. Such an arrangement provides utility for the user because a form of seal between the chute portion and the vessel will reduce the possibility of debris and/or liquid leaking away from the vessel. This is of particular utility during transit of specialised concretes that are very fluid, as used in the construction of, for example, self-levelling floor concretes. Whilst this concrete is in transit it is possible, due to it being so fluid, for the concrete to splash out the back, when, for example, the delivery truck requires stopping suddenly whilst travelling up hill. As the brakes are applied, the momentum of the concrete continues forward resulting in the concrete rebounding off the forward dished end, this results in a back wave which can spill onto the road. In an embodiment of the present invention, this is prevented by the apparatus.

According to a second aspect of the present invention there is provided an apparatus for a lorry-based concrete mixer, the apparatus comprising:

a vessel adapted to receive a portion of a concrete mixer discharge chute, in use, securing the discharge chute in a chute stowed position, the vessel, when engaged with the discharge chute portion, being adapted to receive and retain debris exiting the discharge chute portion.

In an embodiment of the invention, an apparatus is provided which both secures a discharge chute in a chute stowed position and prevents debris leaving the chute from entering the surrounding environment and potentially causing damage. Such a system prevents the debris catching aspect being bypassed as it is inherent within the securing feature.

According to a third aspect of the present invention there is provided an apparatus for a lorry-based concrete mixer, the apparatus comprising:

a vessel adapted to receive an end of a concrete mixer discharge chute;

wherein, in use, when the discharge chute portion is received within the vessel, the vessel is positioned to receive and retain debris exiting the discharge chute portion.

According to a fourth aspect of the present invention, there is provided a method of washing down a concrete mixer discharge chute, the method comprising the steps of:

moving the discharge chute to a stowed position; and washing the discharge chute, fluid from the discharge chute exiting a discharge chute portion into a vessel positioned beneath the discharge chute portion.

It will be understood that features listed as being non-essential with respect to any of the above aspects may be applicable to the any of the other aspects and are not repeated for brevity.

BRIEF DESCRIPTION OF THE DRAWINGS

Embodiments of the present invention will now be described with reference to the Figures, in which.

DETAILED DESCRIPTION OF THE DRAWINGS

Figure 1:
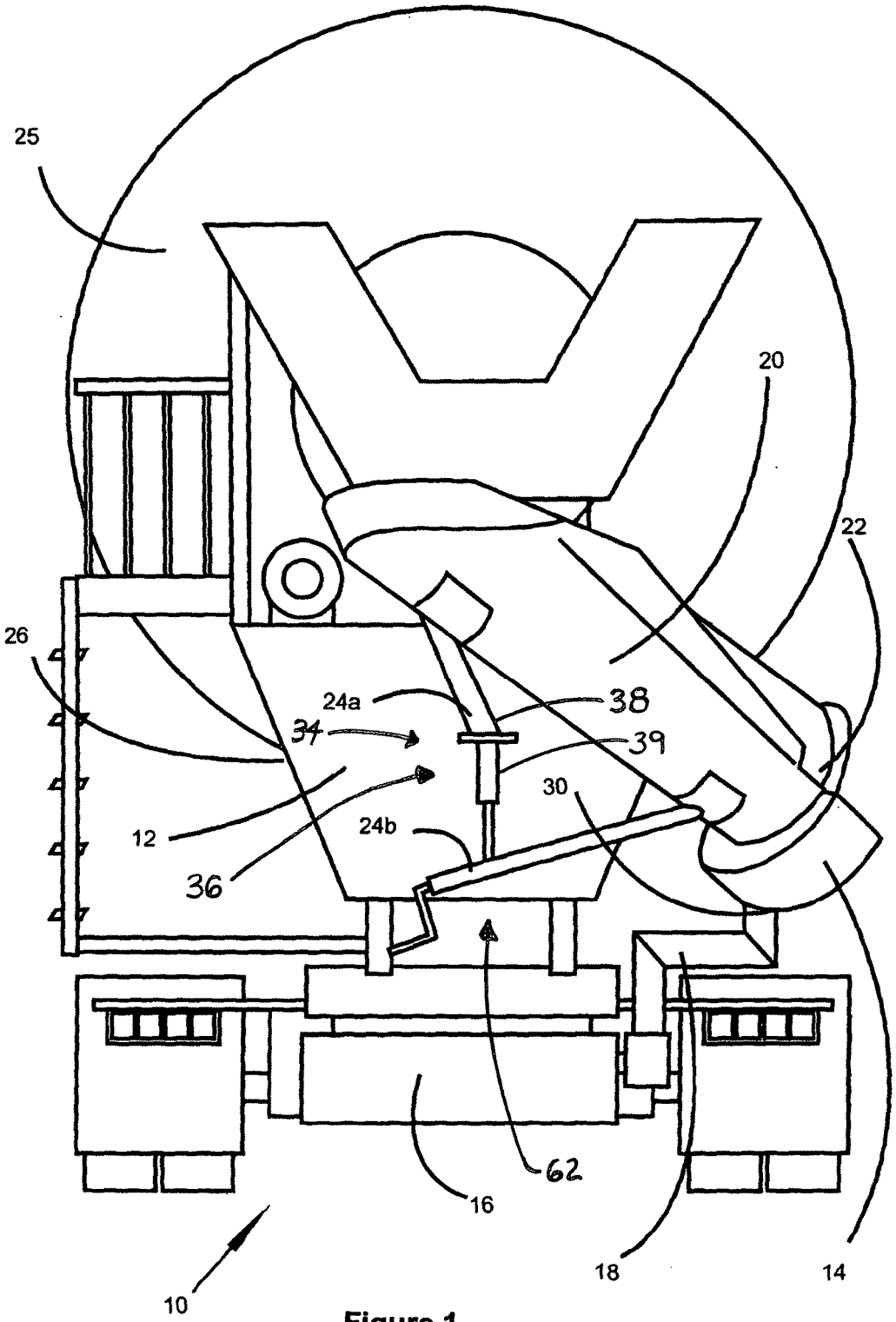
FIG. 1 is a side view of an apparatus for a lorry-based concrete mixer according to a first embodiment of the present invention.
Figure 2:
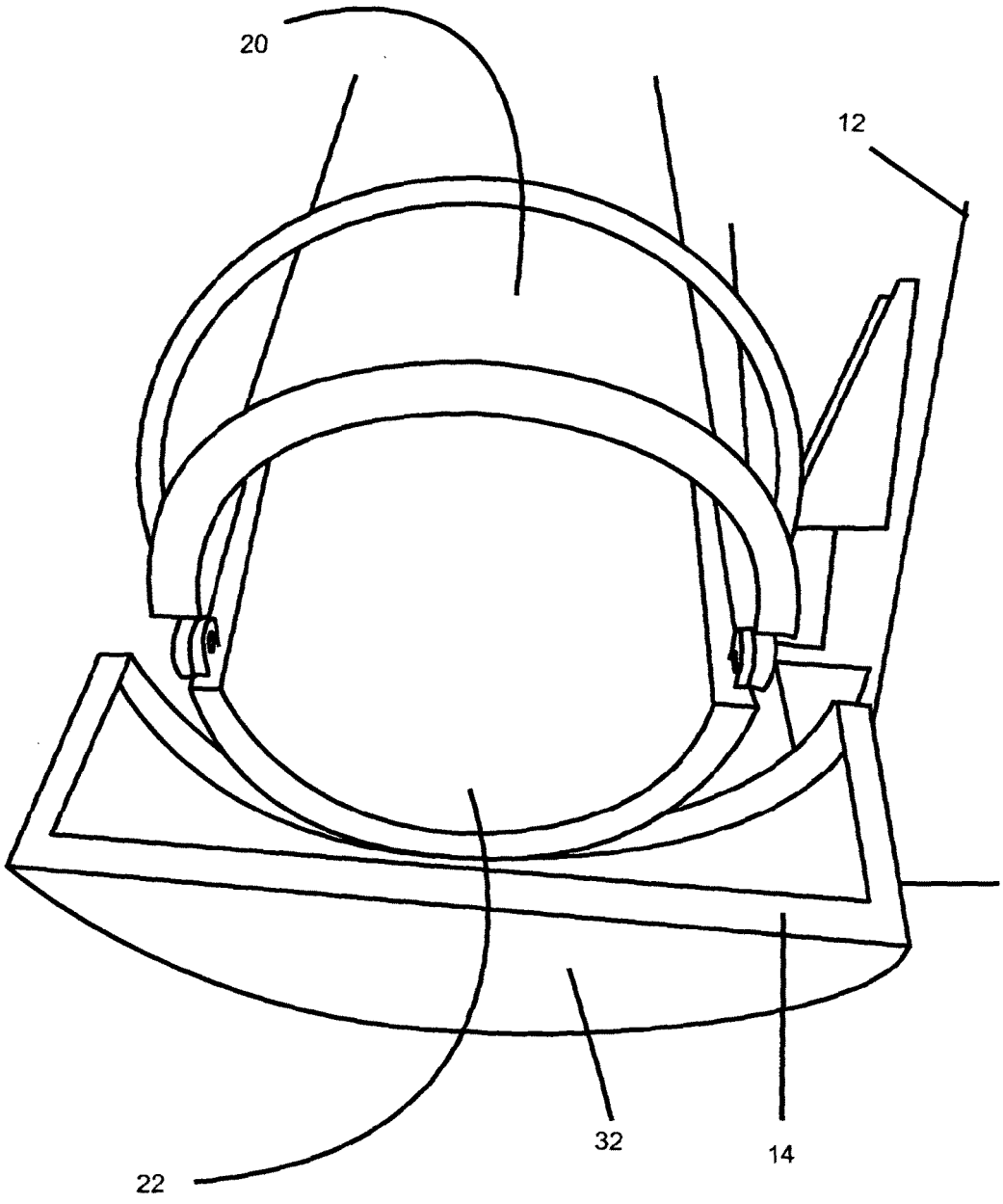
FIG. 2 is a close-up view of part of the apparatus of FIG. 1.

A first embodiment of the present invention will now be described with reference to FIGS. 1 and 2, showing a side view of an apparatus, generally indicated by reference numeral 10, for a lorry-based concrete mixer 12 and a close-up view of part of the apparatus 10 of FIG. 1 respectively.

The apparatus 10 comprises a vessel 14 connected to a storage container 16 by a pipe 18. The storage container 16 and pipe 18 are mounted to a lorry-based concrete mixer 12. The concrete mixer 12 includes a drum 25, a mixer body 26 and a discharge chute 20 having an open unobstructed arcuate outlet 22. The discharge chute 20 is movable relative to the mixer body 26 and is shown in FIGS. 1 and 2 in a stowed position in which it is swung close to the mixer body 26. The apparatus 10 comprises a securing means 62 adapted to secure the discharge chute to the lorry-based concrete mixer 12 in the stowed position. As can be seen, in this position, the chute outlet 22 is secured within the vessel 14. Particularly, in this position, the chute 20 cannot swing away from the stowed position should there be a failure in the brackets 24A, 24B, securing the chute to the mixer body 26. In this stowed position, and particularly after discharge of concrete, the chute 20 can be washed down, the washing water being captured within the vessel 14 and fed through a vessel outlet 30 into the storage container 16 via the pipe 18.

The apparatus 10 further comprises a securing portion 34 (securing means) adapted to secure the discharge chute 20 to the lorry-based concrete mixer 12. The securing portion 34 may be a securing mechanism 36 adapted to secure the discharge chute 20 to a frame or chassis of the lorry-based concrete mixer 12. The securing mechanism 36 may be adapted to secure the outlet 22 over the vessel 14. The securing mechanism 36 may be a male member 38 attached to one of the discharge chute 20 or, in use, a frame or chassis of the lorry-based concrete mixer 12, and female member 39 attached to the other of the discharge chute 20 or frame or chassis of the lorry-based concrete mixer 12. The male member 38 and female member 39, once engaged, may be arranged to prevent movement of the discharge chute 20 in a horizontal plane. Such an arrangement prevents the discharge chute 20 from swinging from the stowed position to the discharge position. The securing portion 34 may be the primary method of securing the discharge chute 20 in the stowed position.

Referring particularly to FIG. 2, the vessel 14 includes a back plate 32 which, in use, prevents debris which may exit the chute outlet 22, from leaving the vicinity of the mixer 12 by catching it and retaining it within the vessel 14.

Figure 3:
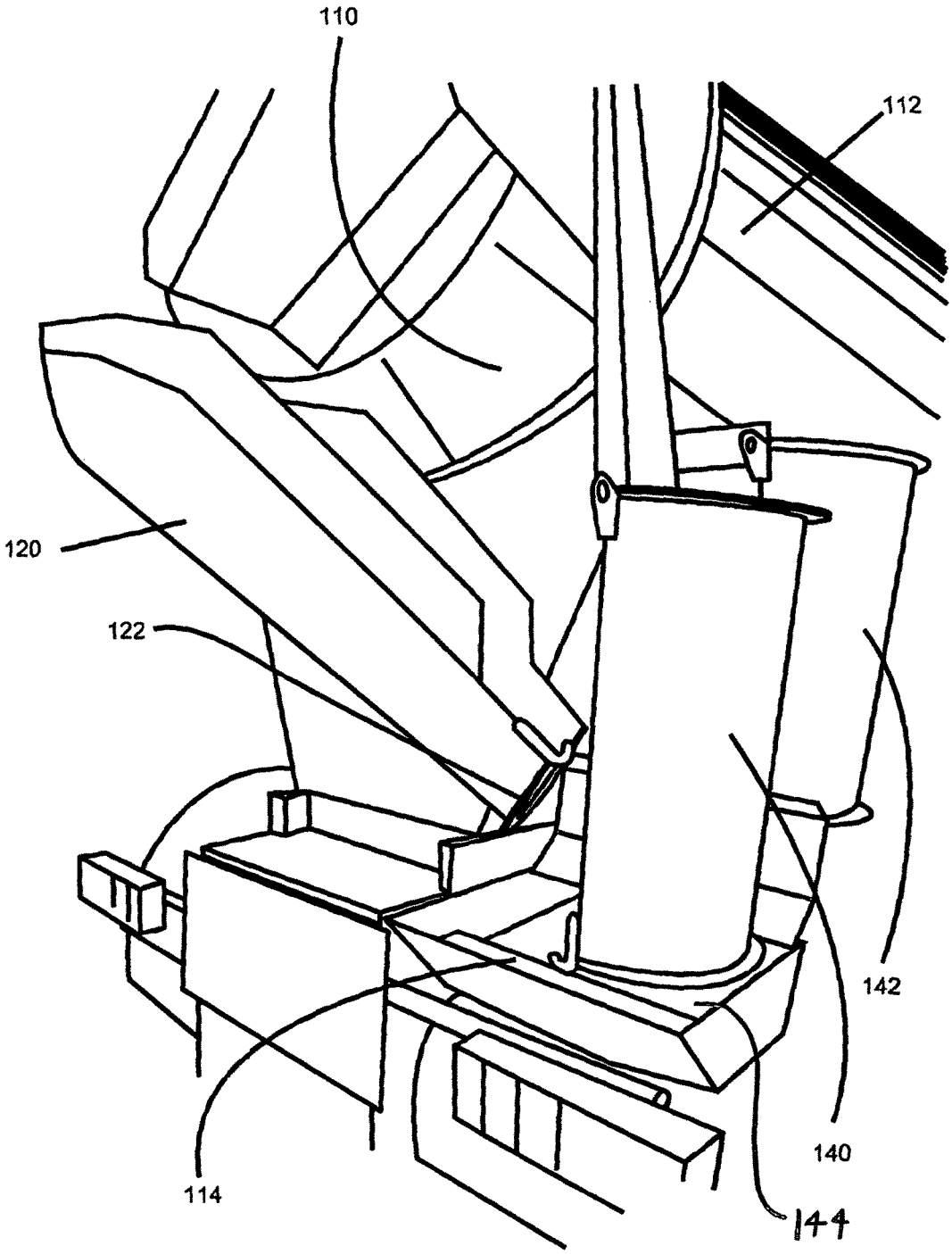
FIG. 3 is a first perspective view of an apparatus for a lorry-based concrete mixer according to a second embodiment of the present invention.
Figure 4:
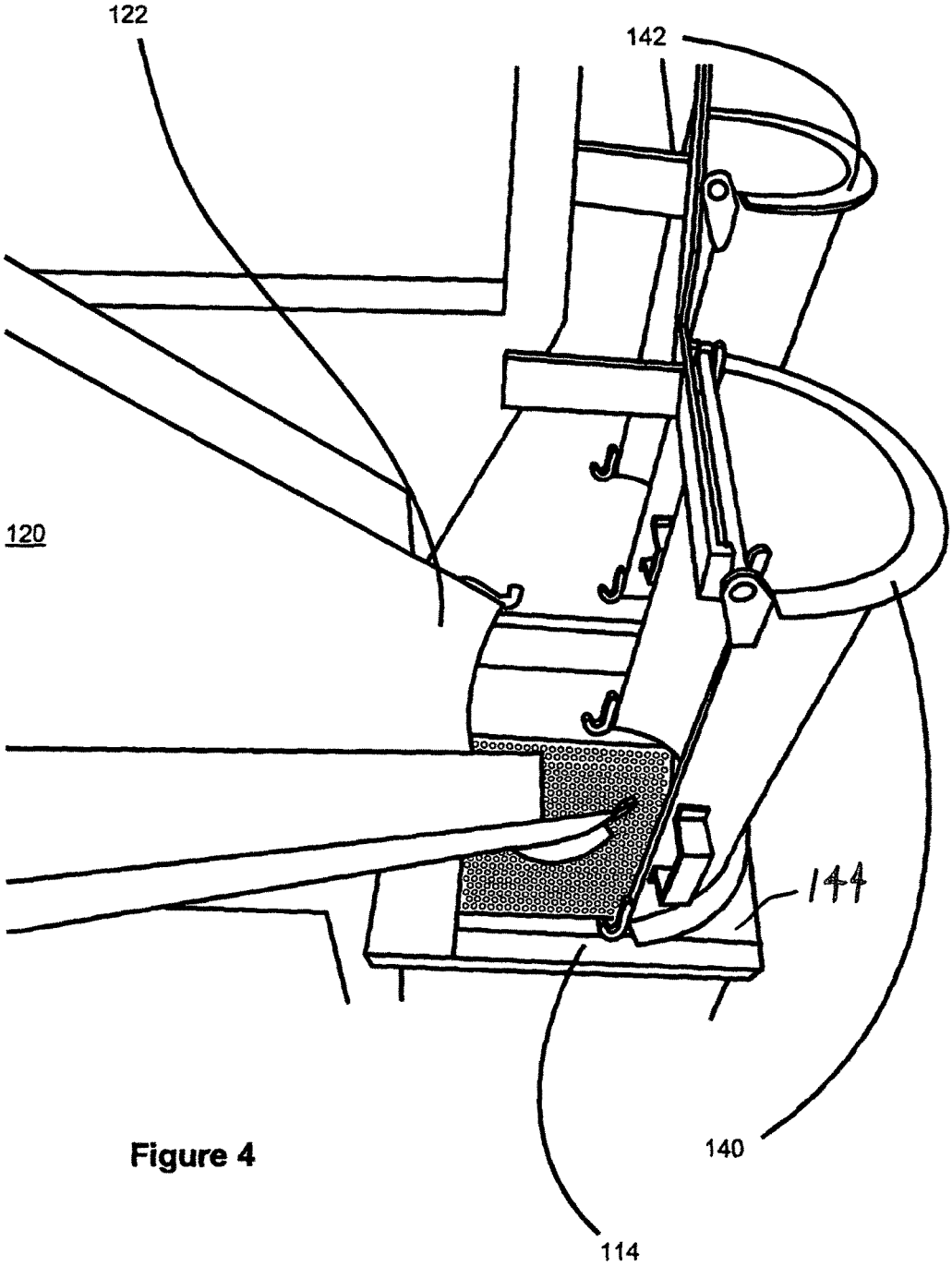
FIG. 4 is a second perspective view of the apparatus of FIG. 3.

Referring to FIGS. 3 and 4, a first and a second perspective views of an apparatus 110 for a lorry-based concrete mixer, a slightly different arrangement is that shown for the apparatus 10 of FIGS. 1 and 2. In this apparatus 110, the open arcuate outlet 122 at the end of the discharge chute sits above the vessel 114 and debris exiting the lorry-based concrete mixer 112 will fall off the open end 122 of the discharge chute 120 and fall into the vessel 114. A secondary chute 140 which, in use, is attachable to the chute outlet 122 to provide extra utility when depositing concrete, is, in this stowed position, positioned around the chute outlet 122 to deflect debris, which may otherwise miss the vessel 114, into the vessel 114. In this position, the secondary chute 140 can also be cleaned with the washing water being captured within the vessel 114. A third chute 142 is also shown in the stowed position displaced from the vessel 114 however in further embodiments, this third chute 142 may also be positioned around the chute outlet 122 to deflect debris.

The apparatus 110 further comprises a storage portion 144 (storage means) adapted to secure the at least one secondary chute 140 in the stowed position, preferably adjacent the chute outlet 122. It is preferred that the at least one secondary chute 140 be stored in a position such that the debris and/or fluid exiting the chute outlet 122 is directed towards the vessel 114, for instance by being suspended above the vessel 114. Further, the storage portion 144 is adapted to secure the at least one secondary chute 140 in both the stowed position and in a discharge position.

It will be seen that the apparatus provides utility by securing the chute in the stowed position, preventing debris exiting the chute and causing damage and by providing a means of storing waste water which has been used to wash down the chute.

It will be understood that modifications and improvements may be meters above described embodiments without departing from the scope of the invention.

The invention claimed is:

1. An apparatus comprising:

a lorry-based concrete mixer comprising a body and a drum;

a discharge chute having an inlet and an open unobstructed arcuate outlet, wherein the inlet is arranged to receive any material exiting the drum whilst the lorry-based concrete mixer is moving in transit;

said discharge chute being movable between an in-transit stowed position and a discharge position, wherein in the in-transit stowed position the discharge chute is positioned proximate the body;

a vessel attached to the body and positioned relative to the body such that upon moving the discharge chute to the in-transit stowed position the open outlet of the discharge chute aligns with the vessel such that the vessel is positioned beneath said open outlet of the discharge chute when the discharge chute is in said in-transit stowed position, and wherein in said in-transit stowed position the vessel is operable to receive and retain any discharge from the drum exiting the open outlet of the discharge chute whilst the lorry-based concrete mixer is moving in transit, and also wherein in said in-transit stowed position the vessel is operable to receive wash-down waste water or slurry from the open outlet of the discharge chute such that any discharge or wash-down waste water from the discharge chute is contained on the lorry-based concrete mixer whilst the lorry-based concrete mixer is moving in transit; and a securing portion adapted to secure the discharge chute in the in-transit stowed position.

2. The apparatus of claim 1, wherein the securing portion is a securing mechanism adapted to secure the discharge chute to the body of the lorry-based concrete mixer.

3. The apparatus of claim 2, wherein the securing mechanism is adapted to secure the open outlet of the discharge chute in line with an inlet to the vessel.

4. The apparatus of claim 2, wherein the securing mechanism is a male member attached to one of the discharge chute or, in use, a frame or chassis of the lorry-based concrete mixer and a female member attached to the other of the discharge chute or frame or chassis of the lorry-based concrete mixer.

5. The apparatus of claim 4, wherein the male and female members, once engaged, are arranged to prevent movement of the discharge chute in a horizontal plane.

6. The apparatus of claim 1, wherein the vessel comprises a vessel outlet.

7. The apparatus of claim 6, wherein the apparatus further comprises a storage container.

8. The apparatus of claim 7, wherein the storage container is adapted to hold the discharge or wash-down waste from the drum.

9. The apparatus of claim 8, wherein the vessel is in fluid communication with the storage container such that the discharge and/or wash-down waste from the drum can pass through the vessel outlet into the storage container.

10. The apparatus of claim 9, wherein the storage container and the vessel outlet are connected by means of a conduit.

11. The apparatus of claim 6, wherein the apparatus further comprises an outlet grill adapted to prevent larger pieces of debris from passing through the vessel outlet.

12. The apparatus of claim 1, wherein the vessel is adapted to receive and retain debris falling from the discharge chute.

13. The apparatus of claim 1, wherein the vessel is adapted to receive the open outlet end of the discharge chute within a vessel interior.

14. The apparatus of claim 1, wherein in the in-transit stowed position, the discharge chute is, in use, positioned above the vessel.

15. The apparatus of any claim 1, wherein in the in-transit stowed position, the discharge chute is lowered towards the vessel, wherein lowering the discharge chute towards the vessel includes the open outlet of the discharge chute being lowered into the vessel.

16. The apparatus of claim 1, wherein the apparatus further comprises a storage portion adapted to secure an at least one secondary chute in an in-transit stowed position, wherein the storage portion is adapted to secure the at least one secondary chute adjacent the discharge chute.

17. The apparatus of claim 16, wherein the storage portion is adapted to position the at least one secondary chute such that the discharge or wash-down waste from the drum exiting the discharge chute is directed towards the vessel.

18. The apparatus of claim 16, wherein the storage portion, in use, suspends the at least one secondary chute above the vessel.

19. The apparatus of claim 16, wherein the storage portion is adapted to secure the at least one secondary chute in the in-transit stowed position adjacent the discharge chute and a discharge position, wherein the secondary chute is attachable to the open outlet of the discharge chute.

20. The apparatus of claim 1, wherein the vessel is, in use, adapted to be fixed relative to the body of the lorry-based concrete mixer.

21. The apparatus of claim 20, wherein the vessel is, in use, removably fixed to the body of the lorry-based concrete mixer.

22. The apparatus of claim 21, wherein the vessel is adapted to be removably received within a cradle defined by the body of the lorry-based concrete mixer.

23. An apparatus comprising:

a lorry-based concrete mixer comprising a body and a mixing drum;

a main chute having an inlet end proximate an outlet of the mixing drum and an open unobstructed arcuate outlet end, which is axially disposed from the inlet end, wherein the inlet end is arranged to receive material from the mixing drum during normal discharge from the mixing drum and to receive material from the mixing drum in the event of accidental discharge from a partially or fully loaded mixing drum whilst the lorry-based concrete mixer is travelling;

said main chute being movable between an in-transit stowed position and a discharge position, wherein the in-transit stowed position is where the main chute is positioned proximate the body and the open outlet end faces towards a side of the lorry-based concrete mixer and in the discharge position, the main chute is positioned such that the open outlet end faces towards a rear of the lorry-based concrete mixer;

a vessel is attached to the body and is positioned relative to the body such that upon moving the main chute to the in-transit stowed position the open outlet end of the main chute is positioned relative to the vessel such that any material exiting the main chute from the open outlet end is discharged into the vessel, wherein the vessel is operable to receive any material, which is discharged from the mixing drum, wherein the discharged material is captured by the main chute, when positioned in said in-transit stowed position and said material is transferred to the vessel via the open outlet end of the main chute whilst the lorry-based concrete mixer is travelling with a partial or full load, and also wherein the vessel is operable to receive wash-down waste water or slurry from the open outlet end of the main chute when positioned in the in-transit stowed position such that during wash-down the wash-down material from the main chute is captured by the vessel for containment on the lorry-based concrete mixer whilst the lorry-based concrete mixer is moving in transit; and wherein the vessel is in fluid communication with a storage container attached to the lorry-based concrete mixer, wherein the storage container is operable to retain the discharged material and/or wash down material from the vessel whilst the lorry-based concrete mixer is travelling between locations and to a dump location, where the storage container can be emptied.

24. An apparatus comprising:

a lorry-based concrete mixer comprising a body, a mixing drum mounted on the body;

a main chute having an inlet end proximate an outlet of the mixing drum and an open unobstructed arcuate outlet end, which is axially disposed from the inlet end, wherein the inlet end is arranged relative to the mixing drum and is arranged to receive material from the mixing drum during normal discharge from the mixing drum and to receive material from the mixing drum in the event of accidental discharge from a partially or fully loaded mixing drum whilst the lorry-based concrete mixer is travelling;

a secondary chute secured by a storage portion adjacent the main chute; and a vessel, which is attached to the body and is positioned relative to the body such that upon moving the main chute to an in-transit stowed position the open outlet end of the main chute is positioned relative to the vessel such that any material exiting the main chute from the open outlet end is discharged into the vessel;

wherein the main chute is movable between the in-transit stowed position wherein the main chute is positioned proximate the body and the open outlet end faces towards a side of the lorry-based concrete mixer and a discharge position wherein the main chute is positioned such that the open outlet end faces towards a rear of the lorry-based concrete mixer and the secondary chute is movable between an in-transit stowed position wherein the storage portion is adapted to secure the secondary chute adjacent the main chute, and a discharge position wherein the secondary chute is attachable to the open outlet end of the discharge chute, wherein the vessel is operable to receive any material, which is discharged from the mixing drum, wherein the discharged material is captured by the main chute when it is positioned in said in-transit stowed position and said material is transferred to the vessel via the open outlet end of the main chute whilst the lorry-based concrete mixer is travelling with a partial or full load, and wherein the secondary chute is arranged to deflect drum material exiting the main chute and direct it to the vessel and wherein the vessel is operable to receive wash-down waste water or slurry from the main chute and the secondary chute when positioned in the in-transit stowed position such that during wash-down the wash-down material from the main chute and the secondary chute is captured by the vessel for containment on the lorry-based concrete mixer whilst the lorry-based concrete mixer is travelling; and wherein the vessel is in fluid communication with a storage container attached to the lorry-based concrete mixer, wherein the storage container is operable to retain the discharged material and/or wash down material from the vessel whilst the lorry-based concrete mixer is travelling between locations and to a dump location, where the storage container can be emptied.

* * * * *